US011344756B1

(12) United States Patent
Kellum

(10) Patent No.: US 11,344,756 B1
(45) Date of Patent: May 31, 2022

(54) UNIVERSAL PROTECTION SYSTEM

(71) Applicant: L J Kellum, Temple, TX (US)

(72) Inventor: L J Kellum, Temple, TX (US)

( * ) Notice: Subject to any disclaimer, the term of this patent is extended or adjusted under 35 U.S.C. 154(b) by 0 days.

(21) Appl. No.: 17/529,569

(22) Filed: Nov. 18, 2021

Related U.S. Application Data

(60) Provisional application No. 63/167,381, filed on Mar. 29, 2021.

(51) Int. Cl.
*A62C 2/10* (2006.01)
*A62C 2/24* (2006.01)

(52) U.S. Cl.
CPC . *A62C 2/10* (2013.01); *A62C 2/24* (2013.01)

(58) Field of Classification Search
CPC ..... A62C 2/10; A62C 2/24
USPC ..... 169/48, 16; 239/208
See application file for complete search history.

(56) References Cited

U.S. PATENT DOCUMENTS 6,742,305 B2 * 6/2004 Rogers ..... E04H 9/14 169/48
8,403,070 B1 * 3/2013 Lowe ..... A62C 3/0257 169/48
8,622,146 B2 * 1/2014 Klimek ..... A62C 3/006 169/56
2008/0217028 A1 * 9/2008 Crumpton ..... A62C 3/0214 169/48
2015/0306435 A1 * 10/2015 Margolin ..... A62C 3/0214 169/48

* cited by examiner

*Primary Examiner* — Christopher S Kim
(74) *Attorney, Agent, or Firm* — William Lovin & Associates LLC; William R. Lovin

(57) ABSTRACT

A fire-protection system comprising two elements is disclosed: 1) A retractable fire-protection covering or mat that may be automatically deployed over a building and stowed after the threat has passed; and, 2) A water fire spray system for wetting the lower aspects of a building to protect the lower and uncovered aspects of a building from fire. Using these systems simultaneously allows the user to mitigate forest and brush fire threats that may periodically threaten a building.

19 Claims, 3 Drawing Sheets

UNIVERSAL PROTECTION SYSTEM

CROSS-REFERENCE TO RELATED APPLICATIONS

This application makes reference to U.S. Prov. App. No. 63/167,381 filed Mar. 29, 2021, and incorporates it in its entirety, by reference.

FIELD OF THE INVENTION

The present invention relates to a fire-protection system comprising two elements: 1) A retractable fire-protection mat that may be automatically deployed over a building and stowed after the threat has passed; and, 2) A water fire spray system for wetting the lower aspects of a building to protect the lower and uncovered aspects of a building from fire. Using these systems simultaneously allows the user to mitigate forest and brush fire threats that may periodically threaten a building.

BACKGROUND OF THE INVENTION

Currently, there are a variety of methods disclosed to mitigate the damage to buildings and other structures from forest and brush fire threats that may periodically occur. Fire-proof blankets that may be placed over a structure to prevent the intrusion of fire are well known. However, deploying these is difficult and labor intensive. Lighter fire-retardant sheets that may be positioned over a structure are also well known. However, these are lighter and subject to being blown off by the high winds that occur in conjunction with a forest or brush fire.

What is needed therefore is a system where blankets that protect the sides and upper aspects of the structure from fire are secured to the structure so that they can be automatically deployed and not blown off during the fire.

Also, what is needed, is a system where a ridged framework is constructed around the outer aspects of a structure and a mat of fire-retardant material, affixed to the rigid framework, is pulled by means of a motor, over the rigid framework so that the mat of fire-retardant material covers essentially all of at least two sides and the roof or upper surfaces of the building to protect them from fire.

Also, what is needed is a water fire spray system that simultaneously activates and wets the lower, exposed aspects and sides of structure not covered by the mat of fire-retardant material.

Finally, what is needed is a method of storing and stowing the mat of fire-retardant material, so that it is hidden out of view when not being used. This method will use a motor to pull the mat of fire-retardant material over the rigid framework and return the mat to the stowing reel from whence it was originally deployed.

SUMMARY OF THE INVENTION

The exemplary embodiment of the present invention is comprised of a roller-deployable and stowable covering or mat of fire-resistant fabric aligned along one side of a building or other structure. A motor is affixed to the end of the receiving roller associated with the roller-deployable and stowable mat to withdraw/deploy the mat from the storing roller associated with the roller-deployable and stowable mat. A motor is affixed to the end of the storing roller associated with the roller-deployable and stowable mat to recover the mat from the receiving roller associated with the roller-deployable and stowable mat. These two motors are used to deploy and recover the mat of fire-resistant fabric before and after the fire-resistant fabric is used.

The receiving and storing rollers are deployed on opposite sides of the building or other structure. They may be mounted underground to hide them from view when not being used. At least at the ends of the receiving and storing rollers are at least two spools for accepting the draw cables affixed to the ends of the fire-resistant fabric wound around the storing roller aligned along the first side of the building or other structure. The draw cables are routed over a set of rollers indirectly attached (e.g., mounted on a metal frame erected over the building or other structure) or directly attached to the building or other structure.

Assuming the building is roughly rectangular in plan, a water fire spray system is deployed on the two sides of the building or other structure that the mat is not aligned along to deliver water to the unprotected lower aspect and sides of the building or other structure. By this means all four sides of a square or rectangular building may be protected during a fire. Additional roller-deployable and stowable mats may be deployed to cover a building with a complex (multi-rectangular section) roof. Also, the roller-deployable and stowable mat may be deployed during time of hailstorm or other weather calamity to protect the roof of the building from flying debris.

DRAWINGS

DETAILED DESCRIPTION

Figure 1:
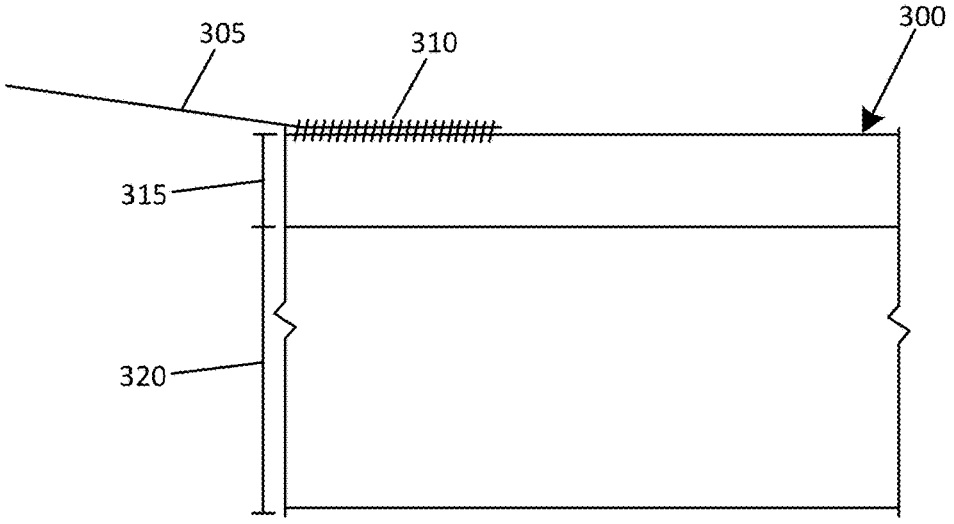
FIG. 1 depicts a side cross-sectional view of exemplary layers for use in a universal protection system to form the roller-deployable and stowable covering or mat.

Turning now to FIG. 1, the layers 300 may be fixedly coupled (e.g., via stitching 310) to a strap 305. A first or outer layer 315 may be a durable and hardy weathering material built to withstand the elements. In at least one example, the layer 315 may be formed of a Gore-Tex™-like material (e.g., having the properties of being waterproof/weatherproof membrane, perhaps also being a breathable (fabric) material). A second or inner layer 320 may be a resilient foam layer, perhaps made out of polyethylene foam, that is configured to compress, while also being non-abrasive. In various examples, some materials in the layers 300 may be formed of fire-retardant material. In some implementations some materials in the layers 300 may be formed of UV resistant materials.

Figure 2:
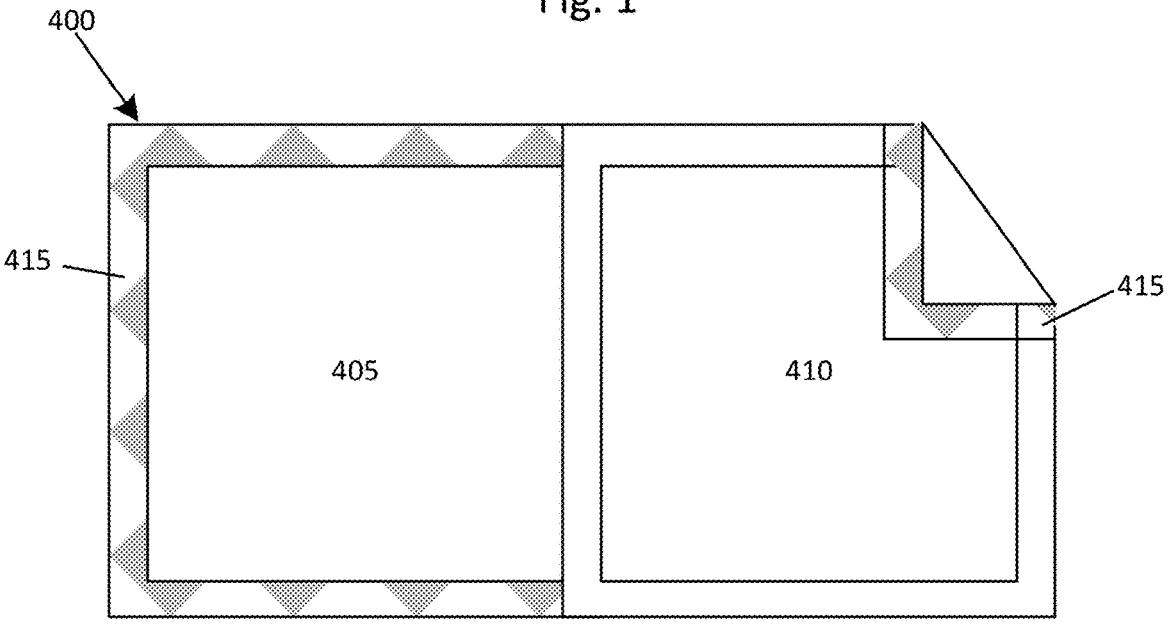
FIG. 2 depicts a plan view of exemplary layers for use in a universal protection system using hook-and-loop fasteners.

Referring now to FIG. 2, a bottom view 405 of a unit of tarp and a top view 410 of an adjacent unit of tarp shown, each including foam padding that can be attached permanently (or releasably coupled) to the tarp backing. A unit of tarp backing may have hook and loop fasteners 415 (as shown in FIG. 2) to couple units modularly together to achieve a customizable width of patches to fit any sized structure (e.g., each patch 405 and 410 can be moved to shape curved, complex shapes, such as the contour of a roof segment). A customizable size protection apparatus may advantageously selectively provide for protection against hail impacts. In various examples, the interior non-fastening region of bottom view 405 and top view 410 may include cushioning (e.g., open closed cell foam, hybrid multi-layers, stiffener material, Styrofoam packing balls, etc.) to distribute impacts.

Figure 3:
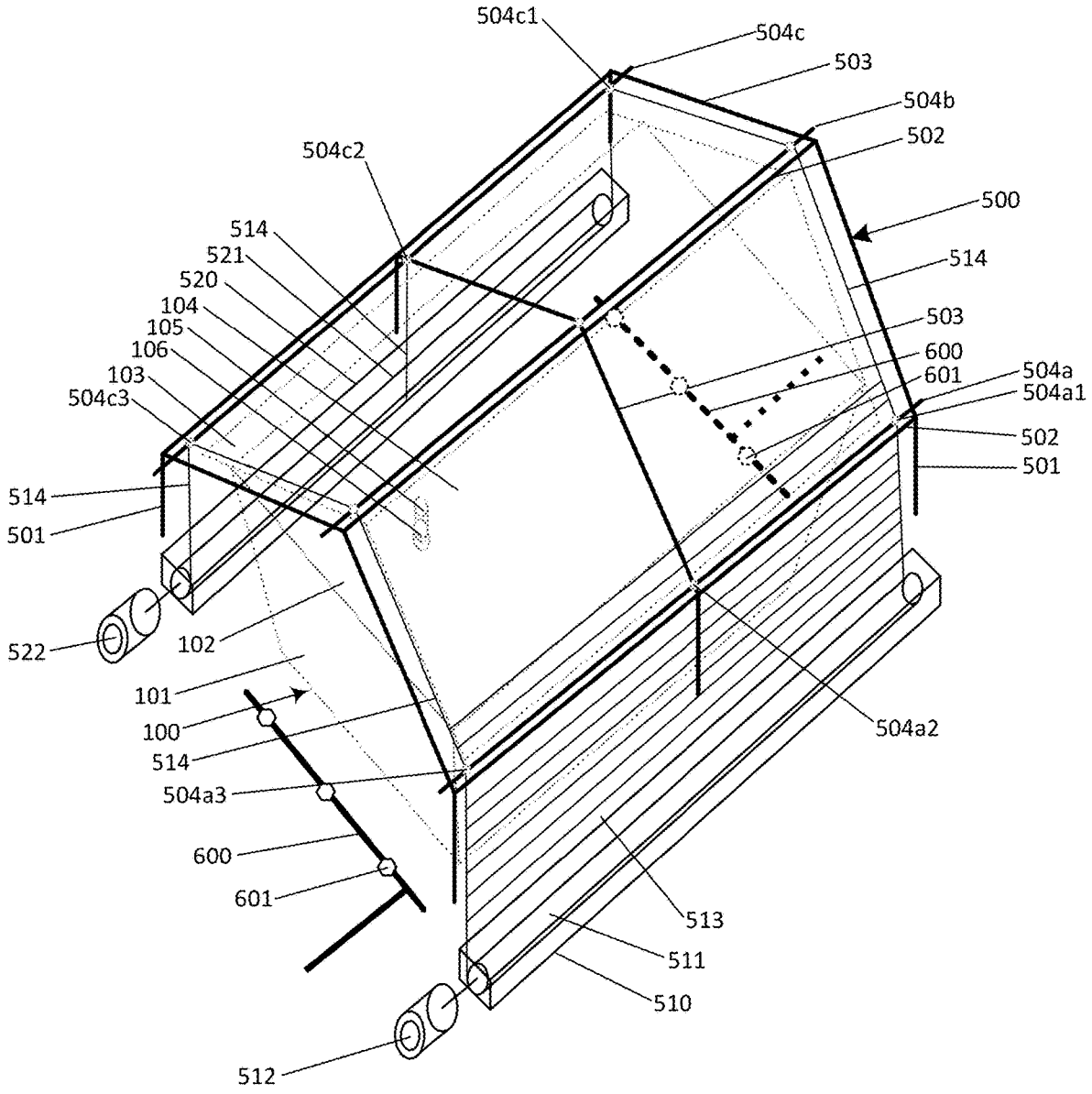
FIG. 3 depicts a side front perspective view of an exemplary building structure outfitted with an exemplary universal protection system.
Figure 4:
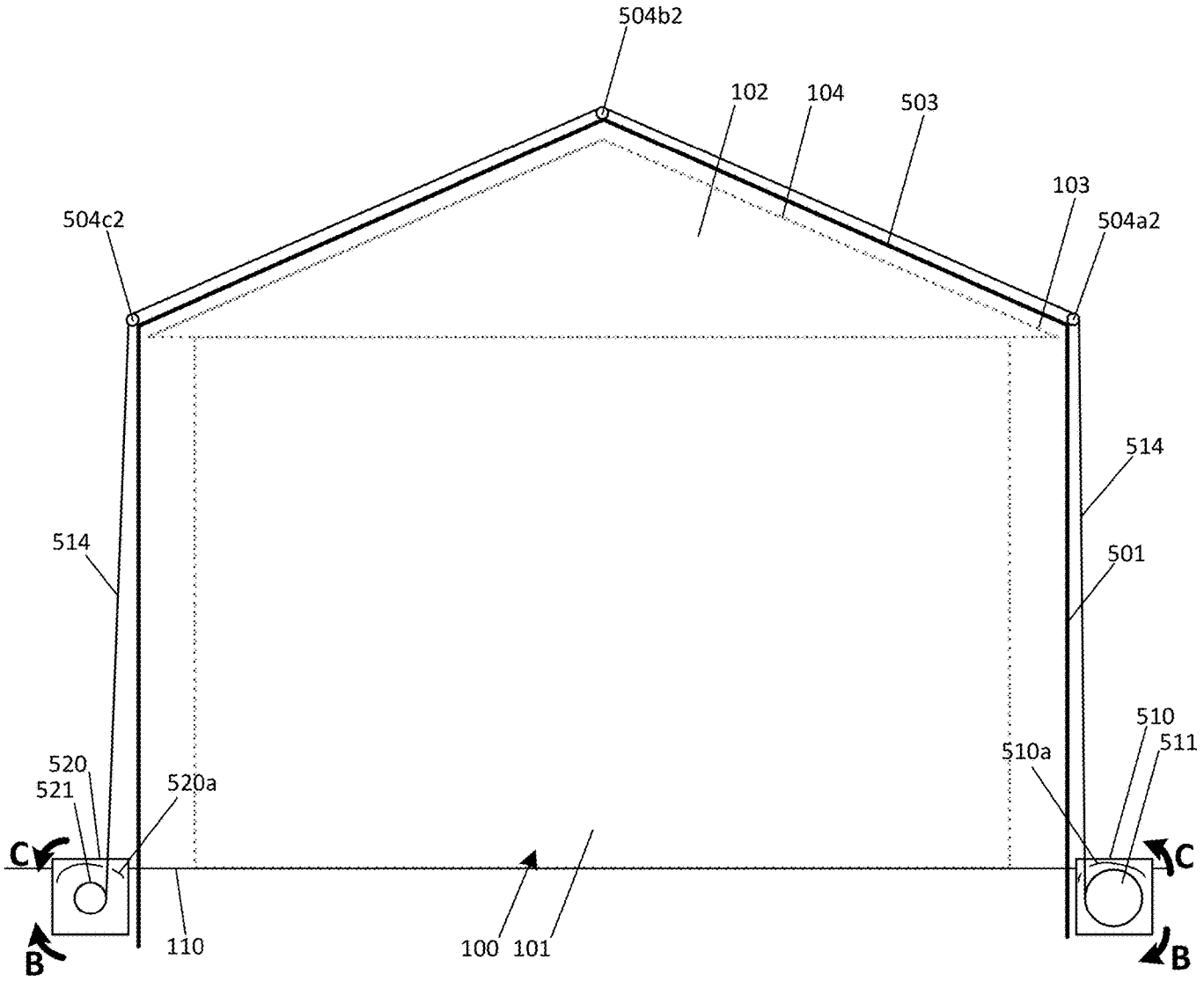
FIG. 4 depicts an elevation view of an exemplary building structure outfitted with an exemplary universal protection system.

Referring now to FIGS. 3 and 4, a building structure 100 through 106 (e.g., a residential home) has been outfitted with an exemplary universal protection system 500 having a rollable protection covering or mat 513. The protection covering or mat 513, in this exemplary embodiment, is an adjustable system configured to selectively deploy (extend/retract) to protect a building 100 through 106 from damage (e.g., wind damage, debris damage, hail damage). In the depicted example, the covering or mat 513 is translatably coupled to multiple rollers—a storing roller 511 and a receiving roller 521. In various examples, each roller 511 and 521 and the protection covering or mat 513, may be releasably coupled to the building 100 through 106 via a framework 501 through 504*c* or using discreet fasteners such as clamps. In the exemplary embodiment, the storing roller 511 is deployed underground in storing roller trench 510 with storing motor 512 attached. The receiving roller 521 is deployed underground on the opposite side of the building 100 through 106 in receiving roller trench 520 with receiving motor 522 attached. Storing motor 512 and receiving motor 522 may be any type of conceivable motors including, without limitation, electric motors or hydraulic motors. Framework 501 through 504*c* may be constructed of any type of conceivable rods including, without limitation, aluminum, steel, or carbon fiber rods. Affixed to framework roof rods 502 are roller roof rods 504*a* through 504*c*. Affixed to roller roof rods 504*a* through 504*c* are rollers 504*a*1 through 504*a*3 through 504*c*1 through 504*c*3. At least one strap 514 is affixed to the leading edge of protection covering or mat 513. In the exemplary embodiment, three straps 514 are affixed to protection covering or mat 513, one at each corner of the leading edge and one in the middle of the leading edge. Straps 514 proceed over framework 501 through 504*c* by means of rollers 504*a*1 through 504*a*3 through 504*c*1 through 504*c*3 affixed to roller roof rods 504*a* through 504*c*. Straps 514 terminate on receiving roller 521 such that when receiving motor 522 rotates receiving roller 521 in direction B the straps 514 are pulled over rollers 504*a*1 through 504*a*3 through 504*c*1 through 504*c*3 affixed to roller roof rods 504*a* through 504*c* drawing protection covering or mat 513 over rollers 504*a*1 through 504*a*3 through 504*c*1 through 504*c*3 affixed to roller roof rods 504*a* through 504*c* and down to receiving roller 521. So as not to interfere with protection covering or mat 513 as it is drawn over the building 100 through 106, roof penetrating vent pipes 105 must be equipped with a flexible roof joint 106 such that vent pipes 105 are bent down against the roof as protection covering or mat 513 is drawn up, over, and down covering the roof 104 and the eaves 103 of the building 100 through 106. Flexible roof joint 106 may be constructed of rubber, silastic, nitrile-rubber-plasticized (NPVC), or thermoplastic vulcanizate (TPV).

After protection covering or mat 513 is drawn over the building 100 through 106 a fire spray system 600 is activated on the two sides of the building 100 through 106 that the protection covering or mat 513 is not aligned along to deliver a protecting substance or a protecting gas by means of at least one spray nozzle 601 to the unprotected lower aspect and sides of the building 100 through 106. Alternative embodiments of the fire spray system 600 also may spray protective substances on the terrain adjoining the building 100 through 106 to limit the approach of fire while the fire is in progress. Alternative embodiments may have a fire spray system 600 that sprays protective substances on the terrain adjoining the building 100 through 106 in all four directions around the building 100 through 106 to limit the approach of fire while the fire is in progress. Alternative embodiments may have a fire spray system 600 that sprays protective substances on the roof 104 and eaves 103 of the building 100 through 106 to limit the approach of fire while the fire is in progress. Alternative embodiments may have no fire spray system 600 protecting the building 100 through 106. Protecting substances may be, without limitation, water, water-based foam, and fire-retardant spray liquids. Protecting gases may be, without limitation, carbon dioxide, hydrogen chloride, and hydrogen bromide. By this means all four sides of a square or rectangular building may be protected during a fire.

After the fire or other calamity has passed, fire spray system 600 is deactivated. Simultaneously, storing motor 512 rotates storing roller 511 in direction C pulling protection covering or mat 513 and the at least one affixed strap 514 so that protection covering or mat 513 is rolled back around back around storing roller 511 ready for a new deployment.

The disclosed invention is used in the following manner: 1) A manually switched, or an automatically derived, stimulus, causes receiving motor 522 affixed to the end of receiving roller 521 associated with the roller-deployable and stowable protection covering or mat 513 to withdraw the protection covering or mat 513 from the storing roller 511 by rotating in direction B. The protection covering or mat 513 is withdrawn and pulled over the building or other structure 100 through 106 by means of a multiplicity of straps 514 affixed to the leading edge of the protection covering or mat 513 by means of passing over a multiplicity of rollers 504*a*1 through 504*a*3 through 504*c*1 through 504*c*3 affixed to roller roof rods 504*a* through 504*c* to be rolled onto receiving roller 521; 2) The same stimulus causes the fire spray system 600 deployed on the two sides of the building or other structure that the protection covering or mat 513 is not aligned along to deliver a fire retardant substance or gas by means of at least one spray nozzle 601 to the unprotected lower aspect and sides of the building or other structure 100 through 106. By this means the uncovered sides of the building or other structure 100 through 106 are provided some level of fire retardance; 3) After the fire or other calamity has passed, the fire spray system 600 is deactivated; and, 4) The storing motor 512 affixed to the end of the storing roller 511 associated with the roller-deployable and stowable protection covering or mat 513 is activated and withdraws the protection covering or mat 513 from the receiving roller 521. The protection covering or mat 513 is pulled over the building or other structure 100 through 106 by means of the multiplicity of straps 514 passing over a multiplicity of rollers 504*a*1 through 504*a*3 through 504*c*1 through 504*c*3 affixed to roller roof rods 504*a* through 504*c* affixed to the building and returned for stowing on the storing roller 511.

Many buildings are comprised of multiple interconnected rectangular areas. Such a building may require that more than one roller-deployable and stowable protection covering or mat 513 be installed to achieve adequate coverage of the roof structure. These additional roller-deployable and stowable protection covering or mats 513 will each be equipped with a storing roller 511 and receiving roller 521 and all other equipment (motors, trenches, etc.) required to deploy and store them. Also, each additional roller-deployable and stowable protection covering or mats 513 may or may not be accompanied by a fire spray system 600.

Various control methods are envisioned. For example, an application running on a cell phone, a tablet computer, a desktop computer, or the like may communicate a stimulus causing the receiving motor 522 and the storing motor 512 to activate to deploy and store protection covering or mat 513, respectively, as desired. Also, an application running on a cell phone, a tablet computer, a desktop computer, or the like may communicate a stimulus causing the fire spray system 600 to activate or cease activation. Also, a manual switch installed inside the building or other structure 100 through 106 may serve to perform equivalent functions. Also, one or more sensors attached to the exterior or interior of the building or other structure 100 through 106 may serve to perform equivalent functions. Also, the fire department or some other civil authority, may have a cell phone, a tablet computer, a desktop computer, or the like to perform equivalent functions. Such a cell phone, a tablet computer, a desktop computer, or the like may be installed in a fire department vehicle or alternately in a government building.

Although various embodiments have been described with reference to the Figures, other embodiments are possible. A number of these implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A universal protection system comprising:

a) a fire retardant protecting covering or mat with at least one strap affixed to its leading edge;

b) a storing roller 1) wherein the fire retardant protecting covering or mat is circumferentially wrapped around a storing roller with the at least one strap exposed;

2) wherein the storing roller is affixed to a storing motor at one end of its rotational axis and the storing roller is buried in a storing trench parallel to one side of a building;

c) a receiving roller wherein the receiving roller is affixed to a receiving motor at one end of its rotational axis and the receiving roller is buried in a receiving trench parallel to the storing roller and the storing trench installed on the opposite side of the building;

d) a framework supporting rollers above the building;

e) wherein the at least one strap proceeds over the rollers and terminates on the receiving roller;

f) a spray fire-retarding system deployed along the sides of the building along which the storing roller and the receiving roller are not deployed;

g) wherein before a fire or other calamity the receiving motor activates and pulls the fire retardant protecting covering or mat by means of the at least one strap over the rollers affixed to the framework and down to the receiving roller and the spray fire-retarding system is activated and begins spraying a protecting substance or gas; and h) after the fire or other calamity has passed 1) the spray fire-retarding system is deactivated and ceases spraying a protecting substance or gas; and 2) the storing motor activates and pulls the fire retardant protecting covering or mat over the rollers affixed to the framework and onto the storing roller.

2. A universal protection system of claim 1 wherein the spray fire-retarding system sprays water as the protecting substance.

3. A universal protection system of claim 1 wherein the spray fire-retarding system sprays water-based foam as the protecting substance.

4. A universal protection system of claim 1 wherein the spray fire-retarding system sprays fire-retardant spray liquid as the protecting substance.

5. A universal protection system of claim 1 wherein the spray fire-retarding system sprays carbon dioxide as the protecting gas.

6. A universal protection system of claim 1 wherein the spray fire-retarding system sprays hydrogen chloride as the protecting gas.

7. A universal protection system of claim 1 wherein the spray fire-retarding system sprays hydrogen bromide as the protecting gas.

8. A universal protection system of claim 1 further comprising at least one additional universal protection system.

9. A universal protection system of claim 8 wherein each additional universal protection system is equipped with a spray fire-retarding system.

10. A universal protection system of claim 8 wherein each additional universal protection system is not equipped with a spray fire-retarding system.

11. A universal protection system of claim 1 wherein roof penetrating vent pipe is equipped with a flexible roof joint.

12. A universal protection system of claim 11 wherein the flexible roof joint is constructed of rubber.

13. A universal protection system of claim 11 wherein the flexible roof joint is constructed of silastic.

14. A universal protection system of claim 11 wherein the flexible roof joint is constructed of nitrile-rubber-plasticized (NPVC).

15. A universal protection system of claim 11 wherein the flexible roof joint is constructed of thermoplastic vulcanizate (TPV).

16. A universal protection system of claim 1 wherein the spray fire-retarding system is installed along and directed towards sides of the building along which the storing and receiving rollers are not deployed.

17. A universal protection system of claim 1 wherein the spray fire-retarding system is installed along and directed towards the roof and eaves of the building.

18. A universal protection system of claim 1 wherein the spray fire-retarding system is installed along and directed towards the terrain adjoining the building and sprays the terrain adjoining the building.

19. A universal protection system comprising:

a) a storing roller with a fire retardant protecting covering or mat with at least one strap affixed to its leading edge wrapped around it with the at least one strap exposed wherein the storing roller is affixed to a storing motor at one end of its rotational axis and the storing roller is buried in a storing trench parallel to one side of a building;

b) a receiving roller wherein the receiving roller is affixed to a receiving motor at one end of its rotational axis and the receiving roller is buried in a receiving trench parallel to the storing roller and storing trench installed on the opposite side of the building;

c) a framework supporting rollers above the building;

d) wherein the at least one strap proceeds over the rollers and terminates on the receiving roller;

e) a spray fire-retarding system on the two sides of the building along which the storing and receiving rollers are not deployed;

f) wherein before a fire or other calamity the receiving motor activates and pulls the fire retardant protecting covering or mat by means of the at least one strap over the rollers affixed to the framework and down to the receiving roller and the spray fire-retarding system activates protecting the two sides of the building along which the storing and the receiving rollers are not deployed; and g) after the fire or other calamity has passed 1) the spray fire retarding system is deactivated; and 2) the storing motor activates and pulls the fire retardant protecting covering or mat over the rollers affixed to the framework and onto the storing roller.

* * * * *